US005678863A

United States Patent [19]

Knight et al.

[11] Patent Number: 5,678,863

[45] Date of Patent: Oct. 21, 1997

[54] HIGH VALUE DOCUMENTS

[75] Inventors: Malcolm Robert Murray Knight, Basingstoke; Roland Isherwood, Whitchurch; Sarah Anne Rocca, Girton; Robin Edward Godfrey, Welwyn; Craig Harvey Nelson, Baldock, all of United Kingdom

[73] Assignee: Portals Limited, London, England

[21] Appl. No.: 374,606

[22] PCT Filed: Jul. 1, 1993

[86] PCT No.: PCT/GB93/01386

§ 371 Date: Jan. 23, 1995

§ 102(e) Date: Jan. 23, 1995

[87] PCT Pub. No.: WO94/02329

PCT Pub. Date: Feb. 3, 1994

[30] Foreign Application Priority Data

Jul. 24, 1992 [GB] United Kingdom ..... 9215828

[51] Int. Cl.[6] ..... B42D 15/00

[52] U.S. Cl. ..... 283/113; 283/72; 283/91; 283/109

[58] Field of Search ..... 283/114, 72, 91, 283/109; 235/379, 380, 487, 491; 428/1

[56] References Cited

U.S. PATENT DOCUMENTS

| | | |
|---|---|---|
| 4,472,627 | 9/1984 | Weinberger . |
| 4,514,085 | 4/1985 | Kaye . |

FOREIGN PATENT DOCUMENTS

| | | |
|---|---|---|
| 488652 | 4/1976 | Australia . |
| 2032587 | 12/1990 | Canada . |
| 0388090 | 9/1990 | European Pat. Off. . |
| 0400220 | 12/1990 | European Pat. Off. . |
| 0435029 | 7/1991 | European Pat. Off. . |
| 2365657 | 4/1978 | France . |
| 2323076 | 11/1973 | Germany . |
| 2805967 | 8/1979 | Germany . |

OTHER PUBLICATIONS

Patent Abstracts of Japan, vol. 015, No. 318 (M-1146) 14 Aug. 1991 + JP-A-31 18198.

Patent Abstracts of Japan,vol. 016, No. 396 (P-1407) 21 Aug. 1992 + JP-A-41 30412.

*Primary Examiner*—Willmon Fridie, Jr.

*Attorney, Agent, or Firm*—Watson Cole Stevens Davis, P.L.L.C.

[57] ABSTRACT

A means of identification or document of value which includes a paper or polymer region, in particular, bank notes, passports, identification cards or any other document of sufficient value to make it liable to be copied or counterfeited, includes a watermark in the region and a liquid crystal material applied to the region and to at least a part of the watermark to produce optical effects which differ when viewed in transmitted and reflected light.

14 Claims, 5 Drawing Sheets

FIG. 7.
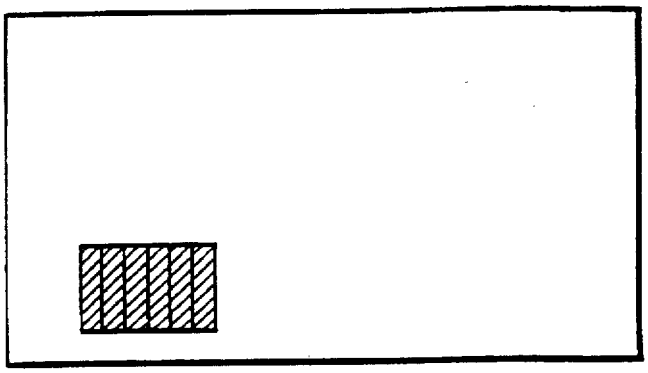
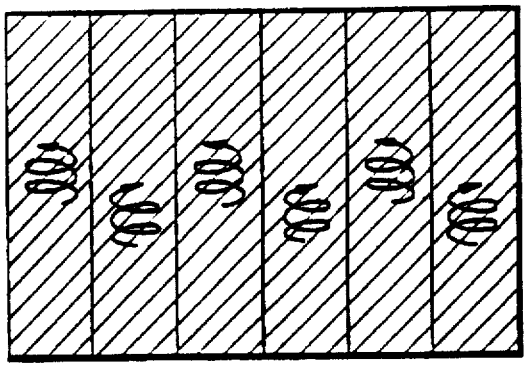
FIG. 8.
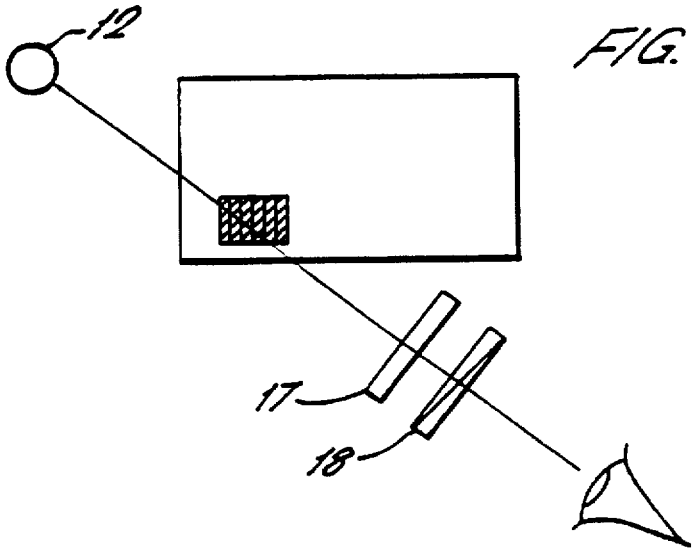
FIG. 9.
FIG. 9a.
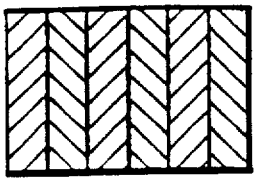

HIGH VALUE DOCUMENTS

The present invention relates to a means of identification or a document of value comprising a paper or polymer region, in particular, bank notes, passports, identification cards or any other document of sufficient value to make it liable to be copied or counterfeited.

The increasing popularity of colour photocopiers and other imaging systems and the improving technical quality of colour photocopies has lead to an increase in the counterfeiting of bank notes, passports and identification cards, etc. There is, therefore, a need to add additional security features to the identification or document of value or to enhance the perceptions and resistance to simulation of existing features. Steps have already been taken to introduce optically variable features into such documentation which cannot be reproduced by a photocopier. There is thus a demand to introduce features which are discernable by the naked eye but "invisible" to, or viewed differently, by a photocopier. Since a photocopying process typically involves reflecting high energy light off an original document containing the image to be copied, one solution would be to incorporate one or more features into the document which have a different perception in reflected and transmitted light, an example being watermarks and enhancements thereof.

It is known that certain liquid crystal materials exhibit a difference in colour when viewed in transmission and reflection as well as an angularly dependent coloured reflection.

Liquid crystal materials have been incorporated into documents, identification cards and other security elements with a view to creating distinctive optical characteristics. EP-A-0435029 is concerned with a data carrier, such as an identification card, which comprises a liquid crystal polymer layer or film in the data carrier. The liquid crystal polymer is in solid form at room temperature and is typically within a laminate structure. The intention is that the liquid crystal layer, which is applied to a black background, will demonstrate a high degree of colour purity in the reflected spectrum for all viewing angles. Automatic testing for verification of authenticity is described using the wavelength and polarisation properties of the reflected light in a single combined measurement. This has the disadvantage of being optically complex using a single absolute reflective measurement requiring a uniform liquid crystal area on a black background. AU-488,652 is also concerned with preventing counterfeit copies by introducing a distinctive optically-variable feature into a security element. This patent discloses the use of a liquid crystal "ink" laminated between two layers of plastic sheet. The liquid crystal is coated on a black background so that only the reflected wavelengths of light are seen as a colour. The patent is primarily concerned with the cholesteric class of liquid crystals which have the characteristic of changing colour with variation in temperature.

Cholesteric liquid crystals have certain unique properties in the chiral nematic phase. It is the chiral nematic phase which produces an angularly dependent coloured reflection and a difference in colour when viewed in either transmission or reflection. Cholesteric liquid crystals form a helical structure which reflects circularly polarised light over a narrow band of wavelengths. The wavelength is a function of the pitch of the helical structure which is formed by alignment within the liquid crystal material. An example of such a structure is depicted in FIG. 1 with the cholesteric helical axis in the direction of the arrow X. The reflection wavelength can be tuned by appropriate choice of chemical composition of the liquid crystal. The materials can be chosen to be temperature sensitive or insensitive. Both handednesses of circularly polarised light can be reflected by choice of the correct materials and thus high reflectivities at specific wavelengths can be achieved with double layers of liquid crystals. The wavelength of reflected light is also dependent on the angle of incidence, which results in a colour change perceived by the viewer as the device is tilted (FIG. 2).

On a dark background, only the reflective effect is observed, since little light is being transmitted from behind. When the dark background is removed or not present and the device is viewed in transmission, the intensity of the transmitted colour swamps the reflective colour.

Of the light which is not reflected, a small proportion is absorbed and the remainder is transmitted through the liquid crystal material 3. When correctly configured, there is a dramatic change between the transmitted colour in the direction of arrow Y and reflected colour in the direction of arrow Z (FIG. 3). The region on either side of the liquid crystal layer 3 in FIG. 3 is a transparent polymer or glass. To achieve this effect on a means of identification or a document of value the area of the document which is occupied by the liquid crystal must be transparent or translucent. The transmitted and reflected colours are complementary, for example, a green reflected colour produces a magenta transmitted colour. It is this characteristic of a liquid crystal material which the present invention seeks to utilise.

According to the present invention there is provided a means of identification or a document of value comprising a translucent or transparant paper or polymer region, and a liquid crystal material applied to the region to produce optical effects which differ when viewed in transmitted and reflected light, characterised in that said region incorporates a watermark, and in that the liquid crystal material has been applied to at least a part of said watermark.

Preferably, the watermark has variations in material density and/or thickness which produce variations in optical density.

In a preferred embodiment of the invention at least part of the paper or polymer region is embossed such that there is at least partial overlap between the embossed region and the region or regions of the paper or polymer on which a liquid crystal has been applied.

The watermark in a document or identification means provides a suitable area which can be enhanced by the application of a liquid crystal material. The change in colour according to viewing conditions, greatly enhances the public perception of the watermark and this substantially enhances the overall security of the document and makes photoreproduction very difficult. However, it should be understood that the term "watermark" includes watermarks produced by the well known cylinder mould-made paper process as well as other processes. The term "watermark" also includes simulated watermarks produced by other means, for example, by printing or compression that produces a localised variation in optical density in a paper or polymer substrate.

Preferably, the liquid crystal material is in liquid form at room temperature.

One advantage of applying the liquid crystal material in a liquid form is that a printing process can be used to print the liquid crystal over the watermark in a vast number of varying designs.

Preferably, the liquid crystal material is enclosed with a containing means.

Preferably, the containing means are microcapsules.

Preferably, the containing means is a laminate structure.

Preferably, the containing means is a honeycombed structure.

Preferably, the containing means is a polymer film comprising a plurality of voids.

Preferably, the containing means are hollow polymer fibres.

Preferably, the liquid crystal material is a solid at room temperature.

Preferably, the identification means/document comprises a laminate, one layer of which comprises the paper or polymer region.

One advantage of the liquid crystal material in solid form is that it can be applied by a transfer process to form a laminate structure with the paper or polymer region.

Preferably, the colour of the light reflected from the region is the complement of the colour of the light transmitted through the region.

Preferably, the liquid crystal region has a pattern of areas of left-handed and right-handed liquid crystal forms.

In a further aspect, the present invention also provides a method of producing a means of identification or a document of value comprising the steps of applying a liquid crystal material to a translucent or transparent paper or polymer region to produce optical effects which differ when viewed in transmission and reflection incorporating said paper or polymer region in the identification means or document, characterised in that a watermark is incorporated in the paper or polymer region and the liquid crystal material is applied to at least a part of the watermark.

Preferably, the liquid crystal material is applied in a liquid form enclosed within a containing means.

Preferably, the liquid crystal material is applied to the region by a printing process.

Preferably, the liquid crystal material is applied in a solid form.

Preferably, the liquid crystal material is applied to the region by a transfer process.

In a further aspect, the present invention provides a method of producing a means of identification or a document of value comprising the steps of applying a liquid crystal material to a translucent or transparent paper or polymer region to produce optical effects which differ when viewed in transmission and reflection incorporating said paper or polymer region in the identification means or document, characterised in that a watermark is incorporated in the paper or polymer region and the liquid crystal material is applied to at least a part of the watermark.

Preferably, light from a light source is transmitted through the liquid crystal region which light then passes through a colour filter, the spectral transmission and reflective properties of which are selected according to the maximum transmitted wavelength through the liquid crystal region, the light then being incident on a photodetector measuring the total transmitted intensity at the given wavelength, and the light reflected from the liquid crystal region is passed through a colour filter, the spectral transmission and reflective properties of which are selected according to the maximum wavelength reflected from the liquid crystal region, the light then being incident on a photodetector measuring the total reflected intensity at the given wavelength.

This has the advantage of being optically simple and is a relative measurement comparing transmitted and reflected light. Due to the comparative nature of the measurement, inspection of small areas is possible, for example, those forming a pattern and the area for inspection can be overprinted if required.

The complementary nature of the colours, one component transmitted and one component reflected, enables direct comparison of the two component wavelength maxima, the wavelength maxima being specific to a given liquid crystal formulation. Such a comparison provides authentication of the document or identification means.

In a further aspect, the present invention provides a method of verifying the authenticity of an identification means or document of value which comprises a liquid crystal region having a pattern of areas of left-handed and right-handed liquid crystal forms by visual or machine inspection of the polarisation states of the areas.

Preferably, the polarisation states of the reflected light are inspected.

Preferably, a quarter-waveplate and a polarising element are used to inspect the polarisation states.

Preferably, the visible colour of the left-handed and right-handed liquid crystal areas produce the same colours on transmission and the same complementary colours on reflection, the pattern being invisible to the unaided eye.

Preferably, the contrast of an area of liquid crystal changes when viewed with and then without the quarter-waveplate and polarising element.

Preferably, the pattern can be verified at high speed by machine inspection of the transmitted and/or reflected light.

A preferred embodiment of the present invention will now be described in detail, by way of example only, with reference to the accompanying drawings, of which:

Figure 4:
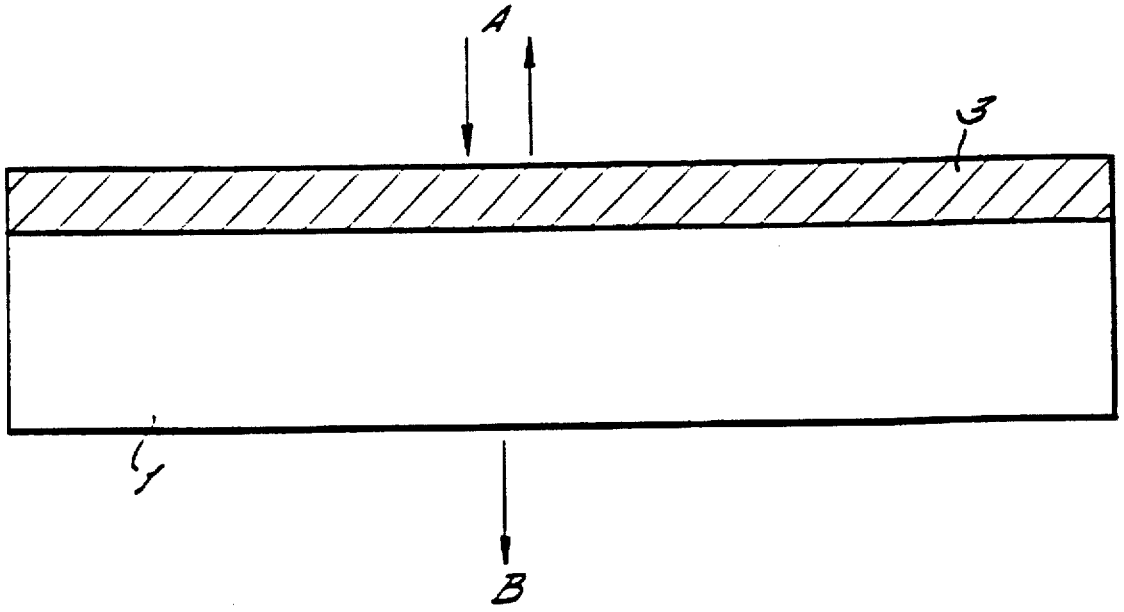
Figure 5A:
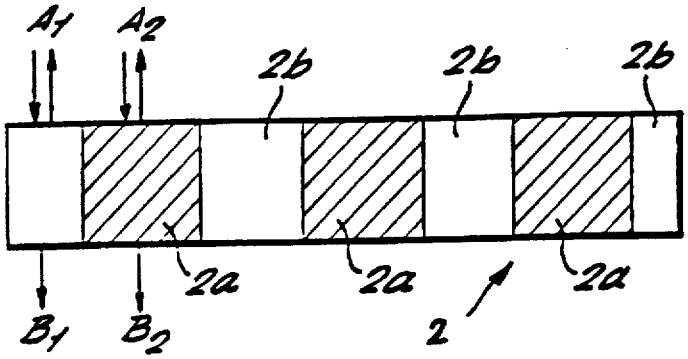
Figure 5B:
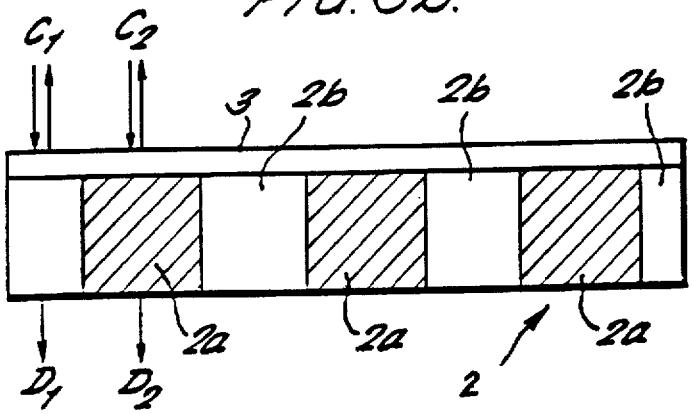
Figure 6:
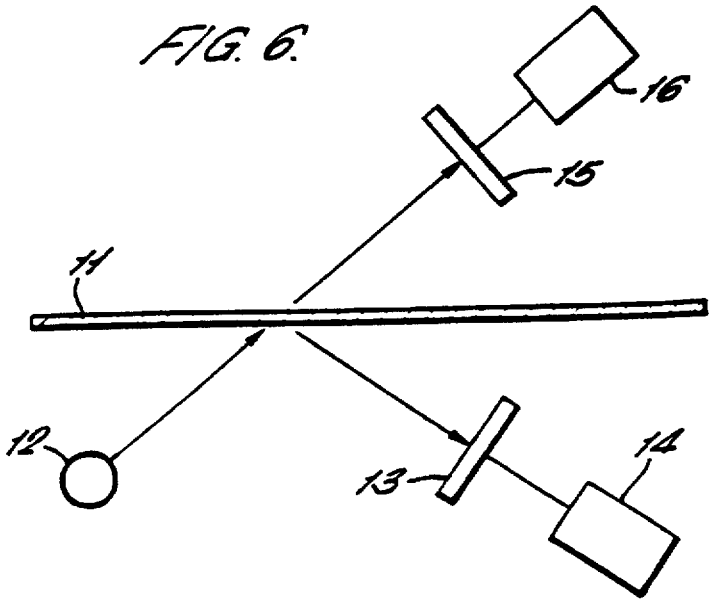

FIG. 4 demonstrates how a paper or polymer region coloured by a liquid crystal material would appear in transmission and reflection;

FIG. 5*a* demonstrates how a monochrome watermark would appear in transmission and reflection;

FIG. 5*b* demonstrates how a watermark coloured by a liquid crystal material, would appear in transmission and reflection;

FIG. 6 demonstrates how the transmitted and reflected wavelengths could be detected to provide a means of visual or machine inspection for authentication;

FIGS. 7, 8, 9 and 9*a* demonstrate how left-handed and right-handed polarisation states can be used in the present invention.

Figure 1:
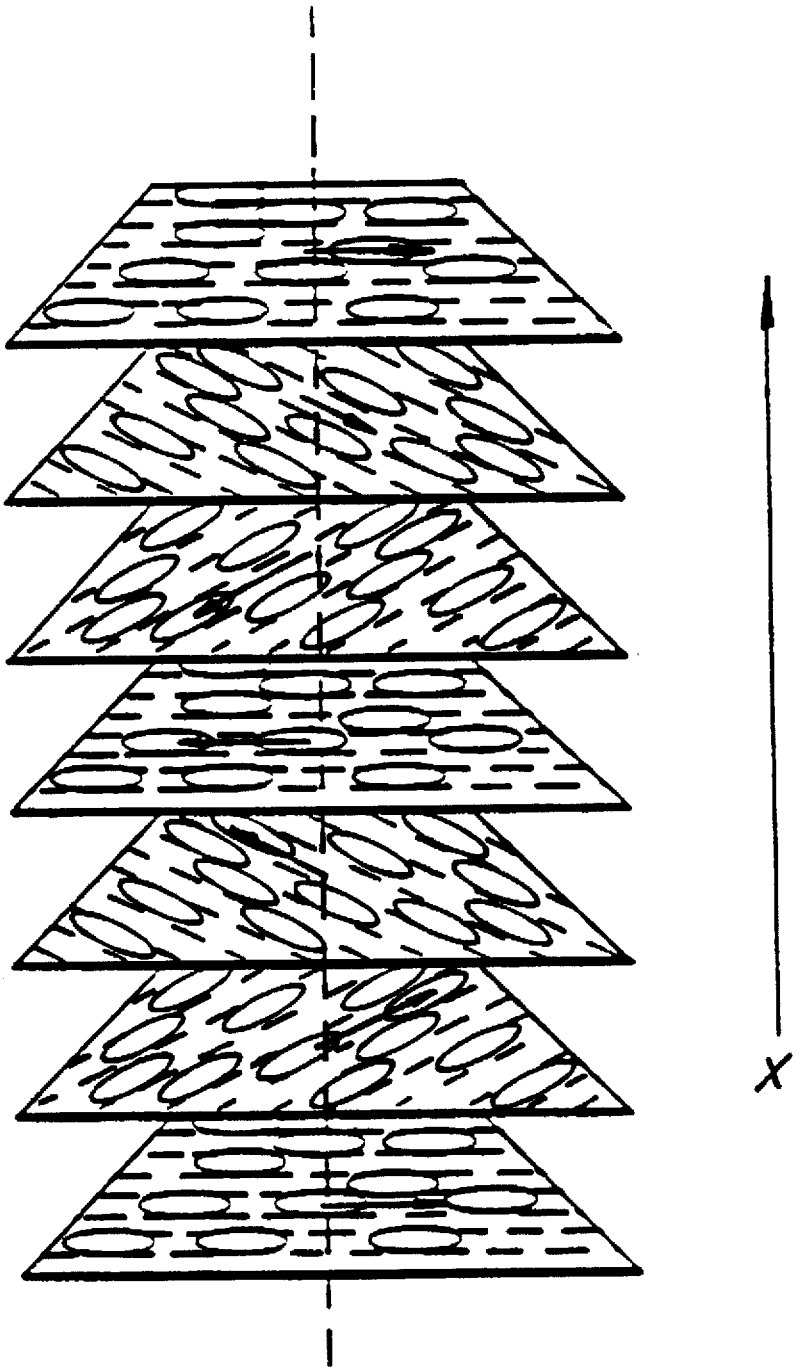
FIG. 1 depicts the chiral nematic alignment of a cholesteric liquid crystal material.
Figure 2:
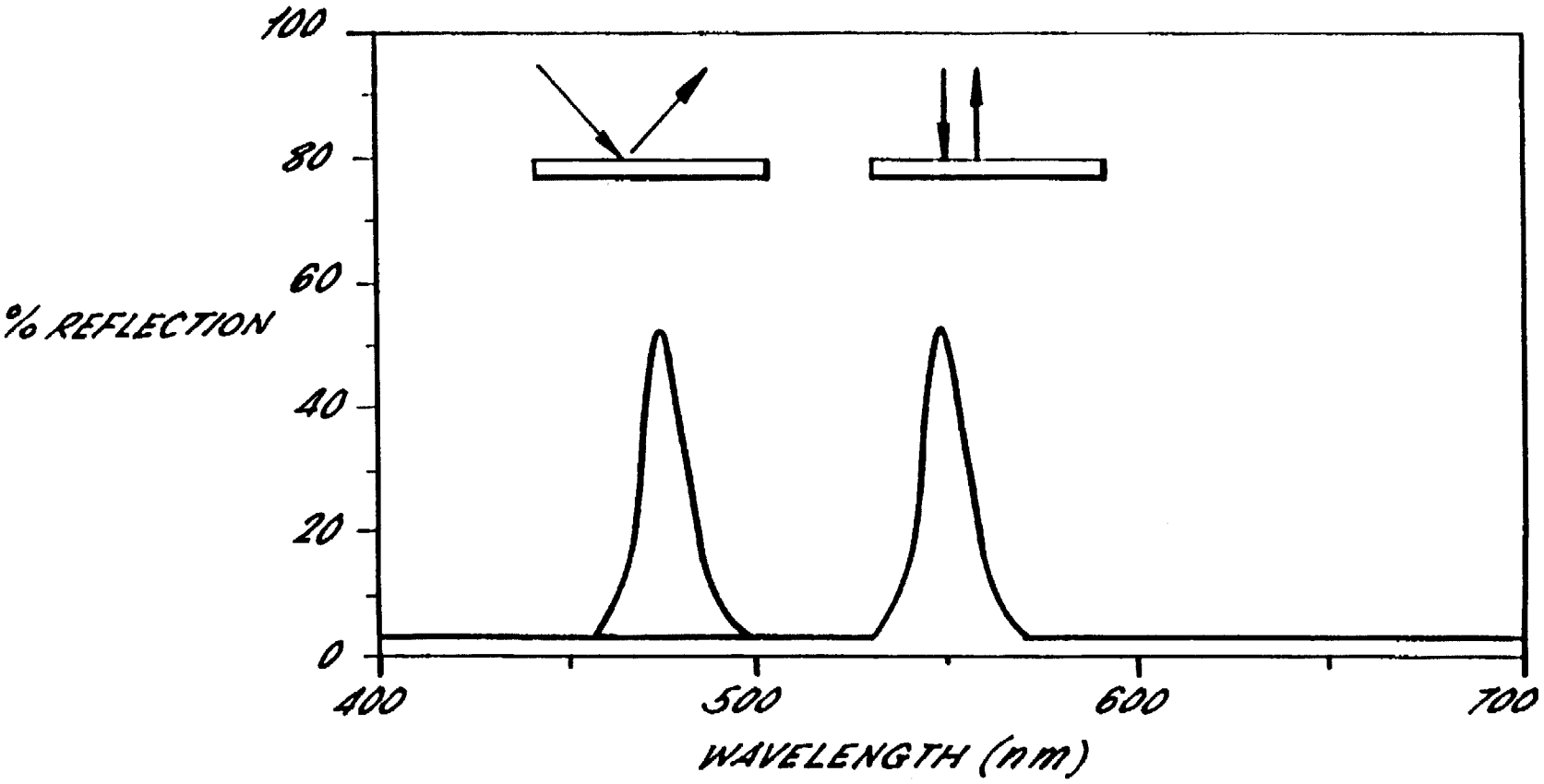
FIG. 2 shows how the reflection from a cholesteric liquid crystal material varies with the angle of incidence.
Figure 3:
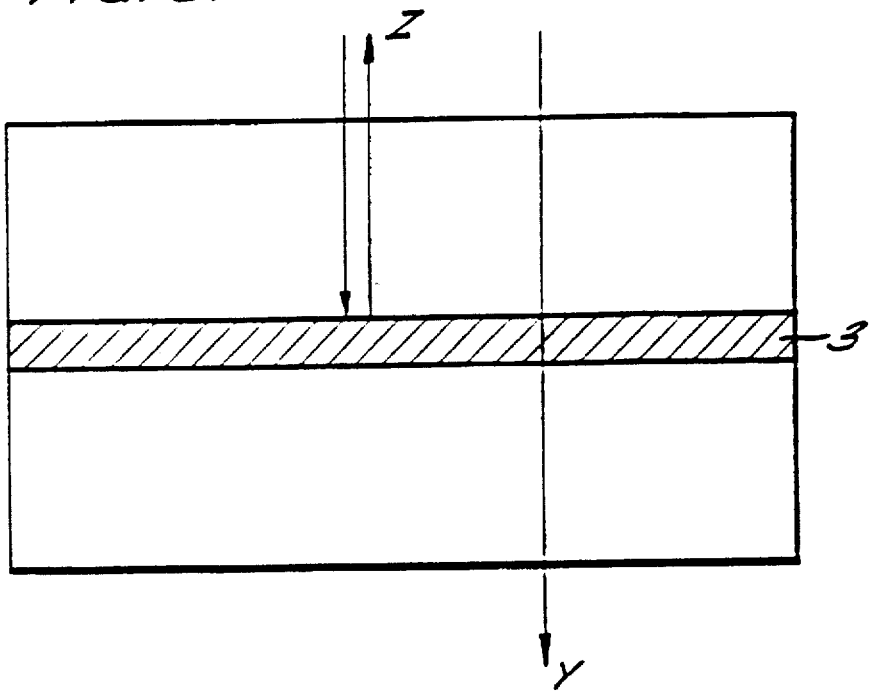
FIG. 3 depicts the transmission and reflection of light incident on a liquid crystal material.

FIGS. 1, 2 and 3 have already been described in detail as background to the present invention.

FIG. 4 depicts a paper or polymer region 1 of a document of value such as a bank note, cheque, postal order, passport, credit card, identification card, etc., which has been provided with a layer of liquid crystal 3. Light reflected at A at a given angle of observation will be coloured, for example, green, whereas light transmitted at B will be coloured at the complementary colour, magenta.

FIG. 5*a* depicts a monochrome watermark 2 in the paper region 1 of a document of value as described above. Should the card be a polymer material, a window in the polymer which comprises paper, could be incorporated in one area of the card. The watermark 2 has regions of high and low optical density 2*a*, 2*b* owing to variations in the paper fibre distribution and thickness which produce the different toned effects in a typical monochrome watermark, for example, as one would see in a portrait watermark in a bank note. The light reflected from a low density region 2*b* will be low ($A_1$)

whereas the light reflected from a high density region 2a will be high ($A_2$). In transmission, the low density region 2b will appear light ($B_1$) and the high density region 2a will appear dark ($B_2$). Thus, the effects in reflection and transmission are the negative of each other.

FIG. 5b depicts a watermark 2 as in FIG. 5a which has been provided with a layer of liquid crystal material 3. The light reflected from a low density region 2b in this case would be perceived as a dark green colour ($C_1$) whereas the light reflected from a high density region 2a would be perceived as a light green colour ($C_2$). In transmission, the colour of light will be the complement of the reflected light, i.e magenta. The low density region 2b will therefore appear light magenta ($D_1$) and the high density region 2a will appear dark magenta ($D_2$). The terms "light" and "dark" used here refer to the perception of light according to intensity, not according to wavelength variation.

FIG. 6 shows a document or identification means containing a liquid crystal region 11. Light from an incandescent source 12 is incident on the liquid crystal region. A portion of the light is reflected from the region through an optical colour filter 13 chosen such that its maximum transmission wavelength is coincident with the maximum wavelength in the light reflected from the liquid crystal at the angle θ. The intensity of the reflected beam at this wavelength is measured by a detector 14.

A portion of the light from the source 12 is also transmitted through the liquid crystal region 11 and is incident on a second optical colour filter 15 chosen such that its maximum transmission wavelength is coincident with the maximum wavelength in the light transmitted by the liquid crystal. The intensity of the transmitted beam at this wavelength is measured by a detector 16.

The signals from detectors 14 and 16 are used by a comparison system, visual or machine, to determine authenticity. Other optical arrangements, filter transmission characteristics and means of signal processing may be selected according to specific requirements for the authentication sensors.

Clearly, different colours of reflected light and transmitted light could be used by altering the liquid crystal material, but in each case the colour of transmitted light would be the complement of the reflected light.

FIG. 7 shows a document or identification means containing a liquid crystal region in the form of a pattern, for example, a bar code. FIG. 8 shows how alternate areas of the liquid crystal region contain left-handed and right-handed forms of liquid crystal. FIG. 9 shows a quarter-waveplate 17 and a polarising element 18 and FIG. 9a shows the image produced when these are used to view the liquid crystal area.

Liquid crystals can be produced with either left-handed or right-handed helical structures which produce the same colour in transmission and its complement on reflection. The pattern described would be invisible to the unaided eye, being visible only when viewed using a suitable detection system such as a quarter-waveplate and polarising element. Alternatively, the pattern would be visible to the unaided eye in the form of a coloured pattern but produce a contrast change when viewed using the described optical elements. Other optical detection systems known in the art may be used according to specific requirements.

Such patterns can be viewed by the eye using specified optical elements or automatically using a photodetector. With an appropriate pattern design, a bar mark for instance, such automatic detection could be undertaken at high speed for machine verification uses.

Verification can be in reflection and/or transmission although for ease of use viewing is preferred in reflection.

An advantage of using liquid crystals with left and right-handed helical structures is that an otherwise invisible pattern, for example a logo or a crest, would become visible when viewed with the described optical elements.

An additional advantage of using such crystals and the apparatus described is that for machine verification it provides a complementary means of verification over and above that provided by colour filtration alone. Yet if the transmitted and reflected colour changes with time, for example due to surface accumulation of dirt, polarisation remains visible as an alternative authentication method.

The liquid crystal material could be incorporated in many other ways, for example, as a windowed thread. The thread could be formatted against a dark background at some points and a transparent background at other points. Such a thread would exhibit a transmission/reflection colour difference at the transparent points and a strong angularly dependent reflected colour at the dark points.

In FIG. 5b the liquid crystal material layer 3 is merely depicted as a layer applied to the watermark. The liquid crystal material could be applied in solid or liquid form to the watermarked paper depending on end requirements.

Liquid crystal materials in a liquid state must be held within a form of container if they are to withstand the production, printing and user environment experienced by the document or identification means. A number of liquid crystal materials exhibit the required chiral nematic phases such as cyano-biphenyls, cholesteryl esters, highly concentrated solutions of chiral molecules, e.g polypeptides and cellulose and liquid crystal polymers such as polyorganosiloxanes. Of these examples, cyano-biphenyls and cholesteryl esters are in a viscous liquid state at room temperature and therefore, require a containing means.

Suitable forms of containing means would be, for example, the following:

(a) microencapsulation (for example, in polyvinylalcohol);

(b) lamination between polymer films;

(c) honeycombed matrix;

(d) voids in a polymer film;

(e) hollow polymer fibres.

A requirement which must be satisfied by the containing means is that the optical path of the length of the container or cells must be of the order of several microns (although this is dependent on the material) to ensure the optical effect is governed by the bulk material rather than by the specific surface effects of the individual containers or cells.

When the liquid crystal material is in a liquid form held within microcapsules, the liquid crystal could be applied to the region by a printing process since the low pressures used would not be sufficient to rupture the majority of the microcapsules. A printing process would be advantageous in that detailed designs could be applied over the watermark thus making reproduction even more difficult for a counterfeiter. Suitable printing processes could utilise, for example, but not exclusively, a gravure, roller, spray or ink jet.

A liquid crystal material held within a laminate or honeycombed structure would necessitate the use of a transfer process to produce a laminate over the watermark. Similarly, a liquid crystal polymer which is typically solid at room temperature would involve a transfer process. Examples of liquid crystal polymers are transesterfied poly (γ-benzyl L-glutamate) and polysiloxanes.

Documents or identification means comprising a paper or polymer region may be transparentised prior to applying the liquid crystal material to ensure that there will be sufficient transmission of light through the document or identification means such that the optical effects described herein are recognisable using the unaided eye. Transparentisation can be achieved chemically by adding a chemical which matches the refractive index of the paper fibres, by treating certain areas of fibres differently at the manufacturing stage, by combining a polymer with the paper at the manufacturing stage and then heat treating the polymer or mechanically by using pressure or other known means.

With the present invention, machine readability of documents and cards could be improved by making the machine "read" both transmitted and reflected light thus putting the document/card on a higher security level.

The use of liquid crystal material may also be used to enhance the appearance of blind intaglio embossing. The embossing may extend, for example, over both plain paper or polymer and a region on which polymer liquid crystal has been applied, i.e. the production of raised regions in the paper or polymer by the known intaglio printing process except that no ink is applied to the intaglio cylinder and therefore there is no ink transferred to the embossed regions of the paper or polymer. By arranging for such regions of blind embossing to at least partially overlap the regions of paper or polymer on which the liquid crystal has been applied, the embossed regions are more apparent on visual inspection, thus enhancing their security value.

In a further embodiment, embossing of the paper or polymer in at least partial overlap with the liquid crystal may occur as part of the normal process of banknote printing; the regions coated with liquid crystal will then also be partially printed with intaglio ink.

Clearly, the present invention should not be limited to the specific embodiments described since it is envisaged that the use of liquid crystal materials in this way will have widespread uses in many industries which are adversely affected by counterfeiting in the manner described.

We claim:

1. A means of identification or a document of value comprising a region selected from a paper region and a polymer region, said region having a characteristic selected from a transparent characteristic and a translucent characteristic, and a liquid crystal material applied to the region to produce optical effects which differ when viewed in transmitted and reflected light, wherein said region incorporates a watermark, and in that the liquid crystal material is applied to at least a part of said watermark.

2. An identification means or document as claimed in claim 1, wherein the watermark has variations, said variations being at least one of variations in material density and thickness which produce variations in optical density.

3. An identification means or document of value as claimed in claim 1, wherein at least part of the paper or polymer region is embossed such that there is at least partial overlap of the embossed and liquid crystal regions.

4. An identification means or document as claimed in claim 1, wherein the liquid crystal material is in liquid form at room temperature.

5. An identification means or document as claimed in claim 1, wherein the liquid crystal material is enclosed within a containing means.

6. An identification means or document as claimed in claim 5, wherein the containing means are microcapsules.

7. An identification means or document as claimed in claim 5, wherein the containing means is a laminate structure.

8. An identification means or document as claimed in claim 5, wherein the containing means is a honeycombed structure.

9. An identification means or document as claimed in claim 5, wherein the containing means is a polymer film comprising a plurality of voids.

10. An identification means or document as claimed in claim 5, wherein the containing means are hollow polymer fibres.

11. An identification means or document as claimed in claim 1, wherein the liquid crystal material is a solid at room temperature.

12. An identification means or document as claimed in claim 1 comprising a laminate, one layer of which comprises the region which is selected from a paper region and a polymer region.

13. An identification means or document as claimed in claim 1, wherein the colour of the light reflected from the region is the complement of the colour of the light transmitted through the region.

14. An identification means or document as claimed in claim 1, wherein the liquid crystal region has a pattern of areas of left-handed and right-handed liquid crystal forms.

* * * * *